US012203211B2

(12) United States Patent
Hagiwara et al.

(10) Patent No.: US 12,203,211 B2
(45) Date of Patent: Jan. 21, 2025

(54) SHEET-LIKE MATERIAL

(71) Applicant: Toray Industries, Inc., Tokyo (JP)

(72) Inventors: Tatsuya Hagiwara, Otsu (JP); Shunichi Miyahara, Gifu (JP); Akihiro Tanabe, Otsu (JP); Makoto Nishimura, Osaka (JP)

(73) Assignee: Toray Industries, Inc., Tokyo (JP)

( * ) Notice: Subject to any disclaimer, the term of this patent is extended or adjusted under 35 U.S.C. 154(b) by 68 days.

(21) Appl. No.: 17/439,862

(22) PCT Filed: Mar. 13, 2020

(86) PCT No.: PCT/JP2020/011303
§ 371 (c)(1),
(2) Date: Sep. 16, 2021

(87) PCT Pub. No.: WO2020/189592
PCT Pub. Date: Sep. 24, 2020

(65) Prior Publication Data

US 2022/0186426 A1 Jun. 16, 2022

(30) Foreign Application Priority Data

Mar. 20, 2019 (JP) ..... 2019-052644
Jul. 5, 2019 (JP) ..... 2019-125899
Oct. 31, 2019 (JP) ..... 2019-198708

(51) Int. Cl.
*D06N 3/00* (2006.01)
*D06N 3/14* (2006.01)

(52) U.S. Cl.
CPC ..... *D06N 3/0004* (2013.01); *D06N 3/0006* (2013.01); *D06N 3/0011* (2013.01); *D06N 3/0013* (2013.01); *D06N 3/0036* (2013.01); *D06N 3/004* (2013.01); *D06N 3/0063* (2013.01); *D06N 3/14* (2013.01); *D06N 2209/0823* (2013.01); *D06N 2211/28* (2013.01)

(58) Field of Classification Search
CPC .. D06N 3/0004; D06N 3/0006; D06N 3/0011; D06N 3/0013; D06N 3/0036; D06N 3/004; D06N 3/0063; D06N 3/14; D06N 3/0056–0068; D06N 2211/28; D06N 2209/0823; D06N 3/0075
See application file for complete search history.

(56) References Cited

U.S. PATENT DOCUMENTS

2004/0063366 A1* 4/2004 Nakayama ..... D06N 3/0065 442/268
2005/0118394 A1* 6/2005 Tanaka ..... D06N 3/0004 442/268
2011/0070422 A1* 3/2011 Ammirati ..... D06N 3/14 428/297.4
2015/0118929 A1 4/2015 Nakai et al.
2017/0198431 A1 7/2017 Ammirati et al.
2017/0211227 A1* 7/2017 Fujisawa ..... D06N 3/0011
2019/0153668 A1 5/2019 Park et al.
2019/0284754 A1 9/2019 Ammirati et al.
2020/0256010 A1 8/2020 Ammirati et al.
2020/0258010 A1 8/2020 Ammirati et al.

FOREIGN PATENT DOCUMENTS

| | | | | |
|---|---|---|---|---|
| CN | 1497098 | A | | 5/2004 |
| CN | 1621607 | A | | 6/2005 |
| CN | 102089472 | A | | 6/2011 |
| CN | 104271832 | A | | 1/2015 |
| CN | 104669764 | A | | 6/2015 |
| EP | 1403421 | A2 | | 3/2004 |
| JP | 2000045186 | A | | 2/2000 |
| JP | 2004143654 | A | | 5/2004 |
| JP | 2005240198 | A | | 9/2005 |
| JP | 2008280643 | A | * | 11/2008 |
| JP | 2011523985 | A | | 8/2011 |
| JP | 2016069790 | A | | 5/2016 |
| JP | 2017133134 | A | * | 8/2017 |
| JP | 2018178297 | A | | 11/2018 |
| JP | 2019143280 | A | | 8/2019 |
| KR | 10-1016161 | B1 | | 2/2011 |
| WO | 2018124524 | A1 | | 7/2018 |

OTHER PUBLICATIONS

"JP2008280643_Machine Translation" is a machine translation of JP-2008280643-A. (Year: 2008).*
"JP2017133134_Machine Translation" is a machine translation of JP-2017133134-A. (Year: 2017).*
Chinese Office Action for Chinese Application No 2020-80021233.3, dated Dec. 28, 2022 h translation, 9 pages.
Extended European Search Report for European Application No. 20772914.6, dated Jan. 9, 2023, 7 pages.
Argentinian Office Action for Argentinian Application No. 20200100783, dated Jan. 12, 2023 with translation, 8 pages.
Indonesian Substantive Examination Result for Indonesian Application No. P00202107616, dated Sep. 30, 2022 with translation, 6 pages.
Indian Examination Report for Indian Application No. 202147042051, dated Jul. 26. 2022, with translation, 7 pages.
(Continued)

*Primary Examiner* — Larissa Rowe Emrich
(74) *Attorney, Agent, or Firm* — Buchanan Ingersoll & Rooney PC

(57) ABSTRACT

A sheet material includes a polymeric elastomer and a fiber-entangled body including, as a constituent element, a nonwoven fabric including ultrafine fibers having an average single fiber diameter of 1.0 μm or more and 10.0 μm or less. The ultrafine fibers include a polyester-based resin including a black pigment ($a_1$). The black pigment ($a_1$) has an average particle diameter of 0.05 μm or more and 0.20 μm or less and has a coefficient of variation (CV) of the average particle diameter of 75% or less. The polymeric elastomer includes a polyurethane including a black pigment (b). The sheet material has a nap coverage of 70% or more and 100% or less on a surface having a nap.

9 Claims, No Drawings

(56) References Cited

OTHER PUBLICATIONS

International Search Report and Written Opinion for International Application No. PCT/JP2020/011303, dated Jun. 16, 2020, 5 pages.
Japanese Office Action, with English translation, for Japanese Application No. 2020-550891, dated Dec. 22, 2020, 14 pages.
Indonesian Substantive Examination for Indonesian Application No. P00202107616, dated Jun. 16, 2023 with translation, 5 pages.
Indian Hearing Notice for Application No. 202147042051, dated Dec. 12, 2023, 2 pages.
Office Action issued Dec. 19, 2023, by the Brazil Patent Office in corresponding Brazilian Patent Application No. BR112021018284-5 and an English translation of the Office Action. (7 pages).
Office Action (Notice of Preliminary Rejection) issued Jan. 31, 2024, by the Korean Intellectual Property Office in corresponding Korean Patent Application No. 10-2021-7029548 and an English translation of the Office Action. (11 pages).
Office Action issued Sep. 24, 2024, by the Brazil Patent Office in corresponding Brazilian Patent Application No. BR112021018284-5 and an English translation of the Office Action. (5 pages).

* cited by examiner

SHEET-LIKE MATERIAL

CROSS REFERENCE TO RELATED APPLICATIONS

This is the U.S. National Phase application of PCT/JP2020/011303, filed Mar. 13, 2020, which claims priority to Japanese Patent Application No. 2019-052644, filed Mar. 20, 2019, Japanese Patent Application No. 2019-125899, filed Jul. 5, 2019, and Japanese Patent Application No. 2019-198708, filed Oct. 31, 2019, the disclosures of these applications being incorporated herein by reference in their entireties for all purposes.

FIELD OF THE INVENTION

The present invention relates to a sheet material that includes a polymeric elastomer and a fiber-entangled body including, as a constituent element, a nonwoven fabric including polyester ultrafine fibers, and is excellent in color fastness, abrasion resistance and strength while having dark-color and homogeneous chromogenic property.

BACKGROUND OF THE INVENTION

A natural leather-like sheet material including a polymeric elastomer and a fiber-entangled body mainly including, as a constituent element, a nonwoven fabric including polyester ultrafine fibers has excellent properties such as high durability and uniform quality in comparison with natural leather, and is used not only as a material for clothing but also in various fields such as vehicle interior material, interior finishing, shoes and clothing. Among them, in the case of using the sheet material for a vehicle interior material, etc., dark-color and homogeneous chromogenic property, such as black, and high lightfastness capable of withstanding practical use are often required.

However, it is known that the polyester fiber has a high refractive index to show poor chromogenic property in comparison with other synthetic fibers such as acetate fiber, acrylic fiber and nylon fiber, and can hardly be dyed in dark color. This tendency is pronounced particularly in an ultrafine fiber, because the specific surface area increases as the fiber diameter decreases. To cope with the problem above, it has been attempted to dye the fiber by increasing the concentration of a dye so as to achieve dark-color and homogeneous chromogenic property. However, in this case, the color fastness of the sheet material such as color fastness to light or color fastness to rubbing is deteriorated. Therefore, a technique for achieving both dark-color and homogeneous chromogenic property and color fastness in a sheet material using polyester ultrafine fibers has long been desired.

To meet this challenge, as a technique for achieving both dark-color and homogeneous chromogenic property and color fastness in a sheet material using ultrafine fibers, a method of adding a pigment to an ultrafine fiber, i.e., a method of using a so-called spun-dyed fiber, has been proposed (see, for example, Patent Literatures 1 to 5).

PATENT LITERATURE

[Patent Literature 1] JP-A-2004-143654
[Patent Literature 2] JP-A-2005-240198
[Patent Literature 3] JP-T-2011-523985 (the term "JP-T" as used herein means a published Japanese translation of a PCT patent application)

[Patent Literature 4] International Publication WO2018/124524
[Patent Literature 5] JP-A-2018-178297

SUMMARY OF THE INVENTION

In the techniques disclosed in Patent Literatures 1 to 5, a pigment having excellent color fastness to light in comparison with a dye is used, whereby color deepening can be achieved to some extent without involving a deterioration in the color fastness to light. However, the pigment contained in the ultrafine fiber tends to reduce the strength of the ultrafine fiber, and the friction characteristics such as color fastness to rubbing may be deteriorated.

The present invention has been completed in consideration of these circumstances, and its object is to provide a sheet material including a polymeric elastomer and a fiber-entangled body including, as a constituent element, a nonwoven fabric including polyester ultrafine fibers, in which the sheet material is excellent in color fastness, abrasion resistance and strength while having dark-color and homogeneous chromogenic property.

The present inventors have made many studies to attain the above-described object. As a result, it has been found that when the average particle diameter of a black pigment in an ultrafine fiber is caused to fall in a specified range and the variation in the average particle diameter is lowered, not only the processing is possible without impairing the operability of spinning but also the reduction in strength of the ultrafine fiber can be kept small.

The present invention has been accomplished based on these findings, and according to the present invention, the following invention is provided.

That is, the sheet material of the present invention is a sheet material including a polymeric elastomer and a fiber-entangled body including, as a constituent element, a nonwoven fabric including ultrafine fibers having an average single fiber diameter of 1.0 μm or more and 10.0 μm or less, in which:

the ultrafine fibers include a polyester-based resin including a black pigment ($a_1$);

the black pigment ($a_1$) has an average particle diameter of 0.05 μm or more and 0.20 μm or less and has a coefficient of variation (CV) of the average particle diameter of 75% or less;

the polymeric elastomer includes a polyurethane including a black pigment (b); and the sheet material has a nap coverage of 70% or more and 100% or less on a surface having a nap.

According to another embodiment, the sheet material of the present invention is a sheet material including a polymeric elastomer and a fiber-entangled body including, as a constituent element, a nonwoven fabric including ultrafine fibers having an average single fiber diameter of 1.0 μm or more and 10.0 μm or less, in which:

the ultrafine fibers include a polyester-based resin including a chromatic fine-particle oxide pigment ($a_2$);

the chromatic fine-particle oxide pigment ($a_2$) has an average particle diameter of 0.05 μm or more and 0.20 μm or less and has a coefficient of variation (CV) of the average particle diameter of 75% or less;

the polymeric elastomer includes a polyurethane including a black pigment (b); and the sheet material has a nap coverage of 70% or more and 100% or less on a surface having a nap.

According to a preferred embodiment of the sheet material of the present invention, the ultrafine fibers have a content (A) of the black pigment ($a_1$) or the chromatic fine-particle oxide pigment ($a_2$) of 0.5 mass % or more and 2.0 mass % or less, and the polymeric elastomer has a content (B) of the black pigment (b), satisfying the below formula relative to the content (A) of the black pigment ($a_1$) or the chromatic fine-particle oxide pigment ($a_2$):

$$(A)/(B) \geq 0.6.$$

According to a preferred embodiment of the sheet material of the present invention, a nap length of the sheet material is 200 μm or more and 500 μm or less.

According to a preferred embodiment of the sheet material of the present invention, the black pigment (b) has an average particle diameter of 0.05 μm or more and 0.20 μm or less and has a coefficient of variation (CV) of the average particle diameter of 75% or less.

According to a preferred embodiment of the sheet material of the present invention, the black pigment (b) is a carbon black.

According to a preferred embodiment of the sheet material of the present invention, the black pigment ($a_1$) and the black pigment (b) are each a carbon black.

According to a preferred embodiment of the sheet material of the present invention, the fiber-entangled body consists of the nonwoven fabric.

According to a preferred embodiment of the sheet material of the present invention, the fiber-entangled body further includes a woven fabric, and the nonwoven fabric and the woven fabric are entangled and integrated with each other.

According to a preferred embodiment of the sheet material of the present invention, the woven fabric includes fibers having an average single fiber diameter of 1.0 μm or more and 50.0 μm or less.

According to a preferred embodiment of the sheet material of the present invention, the fibers constituting the woven fabric are fibers free from the black pigment ($a_1$) and the chromatic fine-particle oxide pigment ($a_2$).

According to the present invention, a sheet material that exhibits excellent color fastness to irradiation with light, rubbing, etc. while having dark-color and homogeneous chromogenic property and has excellent abrasion resistance and excellent surface uniformity can be obtained. In addition, when a fiber-entangled body formed by entangling and integrating a nonwoven fabric and a woven fabric is employed as the fiber-entangled body, artificial leather having also excellent strength in addition to the above-described properties can be obtained.

DETAILED DESCRIPTION OF EMBODIMENTS OF THE INVENTION

The sheet material of the present invention is a sheet material including a polymeric elastomer and a fiber-entangled body including, as a constituent element, a nonwoven fabric including ultrafine fibers having an average single fiber diameter of 1.0 μm or more and 10.0 μm or less, in which:

the ultrafine fibers include a polyester-based resin including a black pigment ($a_1$);

the black pigment ($a_1$) has an average particle diameter of 0.05 μm or more and 0.20 μm or less and has a coefficient of variation (CV) of the average particle diameter of 75% or less;

the polymeric elastomer includes a polyurethane including a black pigment (b); and the sheet material has a nap coverage of 70% or more and 100% or less on a surface having a nap.

According to another embodiment, the sheet material of the present invention is a sheet material including a polymeric elastomer and a fiber-entangled body including, as a constituent element, a nonwoven fabric including ultrafine fibers having an average single fiber diameter of 1.0 μm or more and 10.0 μm or less, in which:

the ultrafine fibers include a polyester-based resin including a chromatic fine-particle oxide pigment ($a_2$);

the chromatic fine-particle oxide pigment ($a_2$) has an average particle diameter of 0.05 μm or more and 0.20 μm or less and has a coefficient of variation (CV) of the average particle diameter of 75% or less;

the polymeric elastomer includes a polyurethane including a black pigment (b); and the sheet material has a nap coverage of 70% or more and 100% or less on a surface having a nap.

These constituent elements are described in detail below, but as long as the gist of the present invention is observed, the present invention is not limited to the below-described ranges.

[Fiber-Entangled Body]

In view of durability, particularly, mechanical strength, heat resistance, etc., it is important that the ultrafine fiber constituting the fiber-entangled body used in the present invention includes a polyester-based resin.

Examples of the polyester-based resin include polyethylene terephthalate, polytrimethylene terephthalate, polytetramethylene terephthalate, polycyclohexylene dimethylene terephthalate, polyethylene-2,6-naphthalene dicarboxylate, and polyethylene-1,2-bis(2-chlorophenoxy)ethane-4,4'-dicarboxylate. Among these, polyethylene terephthalate used most for general purposes, or a polyester copolymer mainly containing an ethylene terephthalate unit is suitably used.

As the polyester-based resin, a single polyester or two or more different kinds of polyesters may be used. In the case of using two or more different kinds of polyesters, in view of compatibility of two or more kinds of components, the difference in intrinsic viscosity (IV value) between the used polyesters is preferably 0.50 or less, and more preferably 0.30 or less.

In the present invention, the intrinsic viscosity is calculated according to the following method:

(1) 0.8 g of a sample polymer is dissolved in 10 mL of ortho-chlorophenol.

(2) The relative viscosity $\eta_r$ is calculated according to the following formula by using an Ostwald viscometer at a temperature of 25° C. and rounded to two decimal places.

$$\eta_r = \eta/\eta_o = (t \times d)/(t_o \times d_o)$$

$$\text{Intrinsic viscosity (IV value)} = 0.0242\eta_r + 0.2634$$

(in which $\eta$ represents the viscosity of the polymer solution, $\eta_o$ represents the viscosity of ortho-chlorophenol, t represents the time (sec) required for falling of the solution, d is the density (g/cm$^3$) of the solution, $t_o$ is the time (sec) required for falling of ortho-chlorophenol, and $d_o$ represents the density (g/cm$^3$) of ortho-chlorophenol).

The cross-sectional shape of the ultrafine fiber is preferably a round cross-section in view of processing operability, but a cross-sectional shape of an irregular cross-section including oval, flat, polygonal such as triangular, fan-shaped, cross-shaped, hollow-shaped, Y-shaped, T-shaped, U-shaped and the like may be employed.

It is important that the average single fiber diameter of ultrafine fibers is 1.0 μm or more and 10.0 μm or less. When the average single fiber diameter of ultrafine fibers is 1.0 μm or more, preferably 1.5 μm or more, an excellent effect is exhibited on the chromogenic property, color fastness to light and color fastness to rubbing after dyeing and on the stability during spinning. On the other hand, when the average single fiber diameter of ultrafine fibers is 10.0 μm or less, preferably 6.0 μm or less, more preferably 4.5 μm or less, a sheet material having an excellent surface quality with a dense and soft touch is obtained.

In the present invention, the average single fiber diameter of the ultrafine fibers is determined by taking a scanning electron microscope (SEM) photograph of a cross-section of the sheet material, randomly selecting 10 circular or nearly circular ellipse-shaped ultrafine fibers, measuring the single fiber diameter thereof, calculating an arithmetic average value of 10 ultrafine fibers, and rounding it to one decimal place. However, in the case of employing an ultrafine fiber having an irregular cross-section, the single fiber diameter is determined by measuring the cross-sectional area of a single fiber and calculating the diameter assuming that the cross-section is circular.

In the present invention, for achieving excellent dark-color chromogenic property, it is important that the polyester-based resin constituting the ultrafine fiber include a black pigment ($a_1$) or chromatic fine-particle oxide pigment ($a_2$) having the average particle diameter of 0.05 μm or more and 0.20 μm or less and the coefficient of variation (CV) of the particle diameter of 75% or less.

The particle diameter as used herein is a particle diameter in the state of the black pigment ($a_1$) or chromatic fine-particle oxide pigment ($a_2$) being present in the ultrafine fiber and indicates a diameter generally referred to as a secondary particle diameter.

When the average of particle diameter is 0.05 μm or more, preferably 0.07 μm or more, the black pigment ($a_1$) or chromatic fine-particle oxide pigment ($a_2$) is held inside the ultrafine fibers and therefore, prevented from falling off the ultrafine fibers. In addition, when the average of particle diameter is 0.20 μm or less, preferably 0.18 μm or less, more preferably 0.16 μm or less, the stability during spinning and the yarn strength become excellent.

When the coefficient of variation (CV) of the particle diameter is 75% or less, preferably 65% or less, more preferably 60% or less, still more preferably 55% or less, and most preferably 50% or less, the particle diameter distribution is lowered, thereby preventing falling off of small particles from the surface, a spinning failure due to excessively aggregated particles, an extreme reduction in the yarn strength, etc.

In the present invention, the average and coefficient of variation (CV) of the particle diameter are calculated according to the following method.

(1) An ultrathin section with a thickness of 5 to 10 μm in the cross-sectional direction of a surface perpendicular to the longitudinal direction of the ultrafine fiber is prepared.

(2) The fiber cross-section in the ultrathin section is observed at 10,000-fold magnification by means of a transmission electron microscope (TEM).

(3) The equivalent-circle diameter of the particle diameter of the black pigment ($a_1$) or chromatic fine-particle oxide pigment ($a_2$) included in a visual field of 2.3 μm×2.3 μm of the observation image is measured at 20 points by using an image analysis software. In the case where the particle of the black pigment ($a_1$) or chromatic fine-particle oxide pigment ($a_2$) included in the visual field of 2.3 μm×2.3 μm is present only at less than 20 points, all equivalent-circle diameters of the particle diameter of the existing black pigment ($a_1$) or chromatic fine-particle oxide pigment ($a_2$) are measured.

(4) With respect to the measured particle diameters at 20 points, the average value (arithmetic average) and coefficient of variation (CV) are calculated. In the present invention, the coefficient of variation is calculated according to the following formula.

Coefficient of variation (%) of particle diameter= (standard deviation of particle diameter)/(arithmetic average of particle diameter)×100

It is preferable that the content (A) of the black pigment ($a_1$) or chromatic fine-particle oxide pigment ($a_2$) included in the polyester-based resin forming the ultrafine fibers is 0.5 mass % or more and 2.0 mass % or less relative to the mass of the ultrafine fiber. When the ratio of the pigment is 0.5 mass % or more, preferably 0.7 mass % or more, more preferably 0.9 mass % or more, the dark-color chromogenic property of the sheet material becomes excellent. When the ratio of the pigment is 2.0 mass % or less, preferably 1.8 mass % or less, more preferably 1.6 mass % or less, a sheet material having high physical properties such as strength elongation can be obtained.

As the black pigment ($a_1$) in the present invention, a carbon-based black pigment such as carbon black or graphite, or an oxide-based black pigment such as triiron tetroxide or copper-chromium composite oxide can be used. Since black pigments having small particle diameters are easy to be obtained and dispersibility in a polymer is excellent, the black pigment ($a_1$) is preferably carbon black.

The chromatic fine-particle oxide pigment ($a_2$) in the present invention indicates a fine-particle oxide pigment having a chromatic color and does not encompass a white oxide pigment such as zinc oxide and titanium oxide.

As the chromatic fine-particle oxide pigment ($a_2$), a known pigment close to the target color can be used, and examples thereof include iron oxyhydroxide (e.g., "TM Yellow 8170" produced by Dainichiseika Color & Chemicals Mfg. Co., Ltd.), iron oxide (e.g., "TM Red 8270" produced by Dainichiseika Color & Chemicals Mfg. Co., Ltd.), and cobalt aluminate (e.g., "TM Blue 3490E" produced by Dainichiseika Color & Chemicals Mfg. Co., Ltd.).

For the polyester-based resin forming the ultrafine fiber, in addition to the black pigment or chromatic fine-particle oxide pigment, an inorganic particle such as titanium oxide particle, a lubricant, a heat stabilizer, an ultraviolet absorber, a conducting agent, a heat storage agent, an antimicrobial, etc. may be added according to various objects, as long as the purpose of the present invention is not inhibited.

In the sheet material of the present invention, the fiber-entangled body including, as a constituent element, a nonwoven fabric including ultrafine fibers including the polyester-based resin above is one of constituent elements.

In the present invention, the "fiber-entangled body including, as a constituent element, a nonwoven fabric" indicates an embodiment where the fiber-entangled body is a nonwoven fabric, an embodiment where the fiber-entangled body is formed by entangling and integrating a nonwoven fabric and a woven fabric as described later, an embodiment where the fiber-entangled body is formed by entangling and integrating a nonwoven fabric and a substrate except for a woven fabric, or the like.

By forming a fiber-entangled body including a nonwoven fabric as a constituent element, a uniform and graceful appearance and texture can be obtained at the time of napping the surface.

The form of the nonwoven fabric includes a long-fiber nonwoven fabric mainly including filaments, and a short-fiber nonwoven fabric mainly including fibers of 100 mm or less. When a long-fiber nonwoven fabric is used as the fibrous substrate, a sheet material having excellent strength can be obtained, and therefore it is preferable. On the other hand, when a short-fiber nonwoven fabric is used, the number of fibers oriented in the thickness direction of the sheet material can be increased in comparison with the case of the long-fiber nonwoven fabric, and the surface of the sheet material can be given a highly dense feeling when napped.

In the case of using a short-fiber nonwoven fabric, the fiber length of the ultrafine fiber is preferably 25 mm or more and 90 mm or less. When the fiber length is 90 mm or less, more preferably 80 mm or less, still more preferably 70 mm or less, good quality and texture are achieved. On the other hand, when the fiber length is 25 mm or more, more preferably 35 mm or more, still more preferably 40 mm or more, a sheet material having excellent abrasion resistance can be obtained.

Mass per unit area of the nonwoven fabric constituting the sheet material according to the present invention is measured in accordance with "6.2 Determination of mass per unit area (ISO method)" of JIS L1913:2010 "Test Methods for Nonwovens", and is preferably in a range of 50 g/m$^2$ or more and 400 g/m$^2$ or less. When the mass per unit area of the nonwoven fabric is 50 g/m$^2$ or more, more preferably 80 g/m$^2$ or more, a sheet material exhibiting a sense of fulfillment and having an excellent texture can be obtained. On the other hand, when the mass per unit area of the nonwoven fabric is 400 g/m$^2$ or less, more preferably 300 g/m$^2$ or less, a flexible sheet material having excellent formability can be obtained.

In the sheet material of the present invention, for the purpose of enhancing the strength and form stability, a woven fabric is preferably stacked inside the nonwoven fabric or stacked on one side of the nonwoven fabric, followed by being entangled and integrated with the nonwoven fabric.

Examples of the type of the fiber constituting the woven fabric, which is used at the time of entangling and integrating of the woven fabric, preferably include a filament yarn, a spun yarn, or a mixed composite yarn of filament yarn and spun yarn. In view of durability, particularly, mechanical strength, etc., it is more preferable to use a multifilament including a polyester-based resin or a polyamide-based resin.

From the viewpoint of mechanical strength, etc., the fiber constituting the woven fabric is preferably free from the black pigment ($a_1$) or chromatic fine-particle oxide pigment ($a_2$).

When the average single fiber diameter of fibers constituting the woven fabric is preferably 50.0 μm or less, more preferably 15.0 μm or less, still more preferably 13.0 μm or less, not only a sheet material having excellent flexibility is obtained but also even when a fiber of the woven fabric is exposed to the surface of the sheet material, since the hue difference from the ultrafine fiber including the pigment is reduced after dyeing, the hue uniformity on the surface is not impaired. On the other hand, when the average single fiber diameter is preferably 1.0 μm or more, more preferably 8.0 μm or more, still more preferably 9.0 μm or more, the form stability of a product as the sheet material is enhanced.

In the present invention, the average single fiber diameter of fibers constituting the woven fabric is determined by taking a scanning electron microscope (SEM) photograph of a cross-section of the sheet material, randomly selecting 10 fibers constituting the woven fabric, measuring the single fiber diameter of the fibers, calculating an arithmetic average value of the 10 fibers, and rounding it to one decimal place.

In the case where the fibers constituting the woven fabric are multifilaments, the total fineness of the multifilaments is measured in accordance with "8.3.1 Fineness based on corrected mass b) Method B (simplified method)" of "8.3 Fineness" of JIS L1013:2010 "Test methods for man-made filament yarns", and is preferably 30 dtex or more and 170 dtex or less.

When the total fineness of yarns constituting the woven fabric is 170 dtex or less, a sheet material having excellent flexibility is obtained. On the other hand, when the total fineness is 30 dtex or more, not only the form stability of a product as the sheet material is enhanced but also at the time of entangling and integrating the nonwoven fabric and the woven fabric by a needle punch, etc., the fibers constituting the woven fabric are less likely to be exposed to the surface of the sheet material, and therefore it is preferable. At this time, the total fineness of multifilament of warps and wefts are preferably the same each other.

Furthermore, the twist count of yarns constituting the woven fabric is preferably 1,000 T/m or more and 4,000 T/m or less. When the twist count is 4,000 T/m or less, more preferably 3,500 T/m or less, still more preferably 3,000 T/m or less, artificial leather having excellent flexibility is obtained. When the twist count is 1,000 T/m or more, more preferably 1,500 T/m or more, still more preferably 2,000 T/m or more, the damage to the fibers constituting the woven fabric can be prevented at the time of entangling and integrating the nonwoven fabric and the woven fabric by a needle punch, etc. and the mechanical strength of the artificial leather becomes excellent, and therefore it is preferable.

[Polymeric Elastomer]

The polymeric elastomer constituting the sheet material of the present invention is a binder for holding ultrafine fibers constituting the sheet material and therefore, considering a soft texture of the sheet material of the present invention, it is important that the used polymeric elastomer is a polyurethane.

The polyurethane forming the polymeric elastomer preferably includes a black pigment (b) having the average particle diameter of 0.05 μm or more and 0.20 μm or less and the coefficient of variation (CV) of the particle diameter of 75% or less.

The particle diameter as used herein is a particle diameter in the state of the black pigment (b) being present in the polymeric elastomer and indicates a diameter generally referred to as a secondary particle diameter.

When the average particle diameter is 0.05 μm or more, preferably 0.07 μm or more, the black pigment (b) is held inside the polymeric elastomer and therefore prevented from falling off the polymeric elastomer. In addition, when the average particle diameter is 0.20 μm or less, preferably 0.18 μm or less, more preferably 0.16 μm or less, the dispersibility at the time of impregnation of the polymeric elastomer becomes excellent.

When the coefficient of variation (CV) of the particle diameter is 75% or less, preferably 65% or less, more preferably 60% or less, still more preferably 55% or less, and most preferably 50% or less, the particle diameter distribution is lowered and falling off of small particles from the surface of the polymeric elastomer, precipitation of excessively aggregated particles in an impregnation tank, or the like is suppressed.

In the present invention, the average and coefficient of variation (CV) of the particle diameter are calculated according to the following method.

(1) An ultrathin section with a thickness of 5 to 10 μm in the cross-sectional direction of a surface perpendicular to the longitudinal direction of the sheet material is prepared.

(2) A cross-section of the polymeric elastomer in the ultrathin section is observed at 10,000-fold magnification by means of a transmission electron microscope (TEM).

(3) The equivalent-circle diameter of the particle diameter of the black pigment (b) included in a visual field of 2.3 μm×2.3 μm of the observation image is measured at 20 points by using an image analysis software. In the case where the particle of the black pigment (b) included in the visual field of 2.3 μm×2.3 μm is present only at less than 20 points, all equivalent-circle diameters of the particle diameter of the existing black pigment (b) are measured.

(4) With respect to the measured particle diameters at 20 points, the average value (arithmetic average) and coefficient of variation (CV) are calculated. In the present invention, the coefficient of variation is calculated according to the following formula.

Coefficient of variation (%) of particle diameter= (standard deviation of particle diameter)/(arithmetic average of particle diameter)×100

As the black pigment (b) in the present invention, a carbon-based black pigment such as carbon black or graphite, or an oxide-based black pigment such as triiron tetroxide or copper-chromium composite oxide can be used. Since black pigments having small particle diameters are easy to be obtained and dispersibility in a polymer is excellent, the black pigment (b) is preferably carbon black.

As for the polyurethane used in the present invention, either an organic solvent-based polyurethane that is used in the state of being dissolved in an organic solvent, or a water-dispersible polyurethane that is used in the state of being dispersed in water may be employed. In addition, as the polyurethane used in the present invention, a polyurethane obtained by the reaction of a polymer diol, an organic diisocyanate, and a chain extender is preferably used.

As the polymer diol, for example, a polycarbonate-based diol, a polyester-based diol, a polyether-based diol, a silicone-based diol, and a fluorine-based diol can be employed, and a copolymer formed by combining these may also be used. Among others, in view of hydrolysis resistance and abrasion resistance, usage of a polycarbonate-based diol is a preferred embodiment.

The polycarbonate-based diol can be produced, for example, by the transesterification reaction of an alkylene glycol and a carbonate ester or by the reaction of phosgene or a chloroformate ester with an alkylene glycol.

Examples of the alkylene glycol include a linear alkylene glycol such as ethylene glycol, propylene glycol, 1,4-butanediol, 1,5-pentanediol, 1,6-hexanediol, 1,9-nonanediol and 1,10-decanediol, a branched alkylene glycol such as neopentyl glycol, 3-methyl-1,5-pentanediol, 2,4-diethyl-1,5-pentanediol and 2-methyl-1,8-octanediol, an alicyclic diol such as 1,4-cyclohexanediol, an aromatic diol such as bisphenol A, glycerin, trimethylolpropane, and pentaerythritol. In the present invention, either a polycarbonate-based diol obtained from a single alkylene glycol, or a copolymerized polycarbonate-based diol obtained from two or more kinds of alkylene glycols can be employed.

Examples of the polyester-based diol include a polyester diol obtained by the condensation of various low-molecular-weight polyols with a polybasic acid.

As the low-molecular-weight polyol, for example, one member or two or more members selected from the group consisting of ethylene glycol, 1,2-propylene glycol, 1,3-propylene glycol, 1,3-butanediol, 1,4-butanediol, 2,2-dimethyl-1,3-propanediol, 1,6-hexanediol, 3-methyl-1,5-pentanediol, 1,8-octanediol, diethylene glycol, triethylene glycol, dipropylene glycol, tripropylene glycol, cyclohexane-1,4-diol, and cyclohexane-1,4-dimethanol can be used.

Furthermore, an adduct formed by adding various alkylene oxides to bisphenol A may also be used.

As the polybasic acid, for example, one member or two or more members selected from the group consisting of succinic acid, maleic acid, adipic acid, glutaric acid, pimelic acid, suberic acid, azelaic acid, sebacic acid, dodecanedicarboxylic acid, phthalic acid, isophthalic acid, terephthalic acid, and hexahydroisophthalic acid can be exemplified.

As the polyether-based diol used in the present invention, for example, polyethylene glycol, polypropylene glycol, polytetramethylene glycol, and a copolymerized diol formed by combining these can be exemplified.

The number average molecular weight of the polymer diol is preferably in a range of 500 or more and 4,000 or less in the case where the molecular weight of the polyurethane-based elastomer is constant. When the number average molecular weight is preferably 500 or more, more preferably 1,500 or more, the sheet material can be prevented from becoming hard. In addition, when the number average molecular weight is preferably 4,000 or less, more preferably to 3,000 or less, the strength as a polyurethane can be maintained.

Examples of the organic diisocyanate used in the present invention include an aliphatic diisocyanate such as hexamethylene diisocyanate, dicyclohexylmethane diisocyanate, isophorone diisocyanate and xylylene diisocyanate, and an aromatic diisocyanates such as diphenylmethane diisocyanate and tolylene diisocyanate, and a combination thereof may also be used.

As the chain extender, an amine-based chain extender such as ethylene diamine and methylene bisaniline, and a diol-based chain extender such as ethylene glycol, can be preferably used. A polyamine obtained by the reaction of a polyisocyanate with water may also be used as the chain extender.

In the polyurethane used in the present invention, a crosslinking agent may be used in combination for the purpose of improving the water resistance, abrasion resistance, hydrolysis resistance, etc. The crosslinking agent may be an external crosslinking agent that is added as a third component to the polyurethane. An internal crosslinking agent that introduces in advance reactive sites forming a crosslinked structure into the polyurethane molecular structure may also be used. From the viewpoint that crosslinking points can be formed more uniformly in the polyurethane molecular structure and the reduction in flexibility can be mitigated, an internal crosslinking agent is preferably used.

As the crosslinking agent, a compound having an isocyanate group, an oxazoline group, a carbodiimide group, an epoxy group, a melamine resin, a silanol group, etc. can be used.

In addition, the polymeric elastomer may contain various additives according to the purpose, such as a flame retardant such as "phosphorus-based, halogen-based and inorganic" flame retardants, an antioxidant such as "phenol-based, sulfur-based and phosphorus-based" antioxidants, an UV absorber such as "benzotriazole-based, benzophenone-based, salicylate-based, cyanoacrylate-based and oxalic acid anilide-based" UV absorbers, a light stabilizer such as "hindered amine-based and benzoate-based" light stabilizers, a hydrolysis stabilizer such as polycarbodiimide, a plasticizer, an antistatic agent, a surfactant, a coagulation modifier, and a dye.

In general, the content of the polymeric elastomer in the sheet material can be appropriately adjusted in consideration of the type of the polymeric elastomer used, the production method of the polymeric elastomer, and the texture or physical properties. In the present invention, the content of the polymeric elastomer is preferably 10 mass % or more and 60 mass % or less, relative to the mass of the fiber-entangled body. When the content of the polymeric elastomer is 10 mass % or more, more preferably 15 mass % or more, still more preferably 20 mass % or more, the bonding between fibers by the polymeric elastomer can be strengthened, and the abrasion resistance of the sheet material can be enhanced. On the other hand, when the content of the polymeric elastomer is 60 mass % or less, more preferably 45 mass % or less, still more preferably 40 mass % or less, a sheet material having higher flexibility can be obtained.

[Sheet Material]

In the sheet material of the present invention, the content (A) of the black pigment ($a_1$) or chromatic fine-particle oxide pigment ($a_2$) included in the ultrafine fiber constituting the sheet material and the content (B) of the black pigment (b) included in the polymeric elastomer preferably satisfy the following formula.

$$(A)/(B) \geq 0.6$$

When (A)/(B) is 0.6 or more, the content (B) of the black pigment (b) included in the polymeric elastomer can be decreased relative to the content (A) of the black pigment ($a_1$) or chromatic fine-particle oxide pigment ($a_2$) included in the ultrafine fiber, so that a sheet material having dark-color and homogeneous chromogenic property can be obtained while precipitation of the black pigment in an impregnation tank in the step of impregnation of the polymeric elastomer, reduction in the strength of the polymeric elastomer, and reduction in the color fastness to rubbing due to falling off of the polymeric elastomer are suppressed.

The sheet material of the present invention has naps on the surface. The sheet material may have naps only on a surface or may also be allowed to have naps on both surfaces. In view of the design effect, in the case of having naps on a surface, the naps is preferably formed to have a nap length and directional flexibility to such an extent that when the user runs a finger, a trace is left due to a change in the direction of naps, that is, a so-called finger mark remains.

More specifically, the nap length on the surface is preferably 200 μm or more and 500 μm or less, more preferably 250 μm or more and 450 μm or less. When the nap length is 200 μm or more, even if the content of the black pigment (b) included in the polymeric elastomer is decreased, within the range satisfying the specified ratio, relative to the content of the black pigment ($a_1$) or chromatic fine-particle oxide pigment ($a_2$) included in the ultrafine fiber, the naps on the surface cover the polymeric elastomer, and exposure of the polymeric elastomer to the surface of the sheet material is suppressed, so that a sheet material having dark-color and homogeneous chromogenic property can be obtained. In addition, in the case where a woven fabric is entangled and integrated with the nonwoven fabric constituting the sheet material, when the nap length on the surface is in the range above, this is preferable in that the naps can sufficiently cover the fibers of the woven fabric near the surface of artificial leather. On the other hand, when the nap length is 500 μm or less, a sheet material excellent in the design effect and abrasion resistance can be obtained.

In the present invention, the nap length of the sheet material is calculated according to the following method.

(1) A thin section with a thickness of 1 mm in the cross-sectional direction of a surface perpendicular to the longitudinal direction of the sheet material is prepared in the state of naps of the sheet material being ruffled by means of a lint brush, etc.

(2) A cross-section of the sheet material is observed at 90-fold magnification by means of a scanning electron microscope (SEM).

(3) In an SEM image photographed, the height of the nap portion (the layer composed of only ultrafine fibers) is measured at 10 points at intervals of 200 μm in the width direction of the cross-section of the sheet material.

(4) With respect to the measured height of the nap portion (the layer composed of only ultrafine fibers) at 10 points, the average value (arithmetic average) is calculated.

In the sheet material of the present invention, it is important that the rate at which naps of the sheet material cover the surface having the naps (nap coverage) is 70% or more and 100% or less. When the nap coverage is 70% or more, even if the content of the black pigment (b) included in the polymeric elastomer is decreased, within the range satisfying the specified ratio, relative to the content of the black pigment ($a_1$) or chromatic fine-particle oxide pigment ($a_2$) included in the ultrafine fiber, exposure of the polymeric elastomer to the surface of the sheet material can be suppressed so that a sheet material having dark-color and homogeneous chromogenic property can be obtained. In the present invention, the average value and coefficient of variation (CV) of the particle diameter of the black pigment ($a_1$) or chromatic fine-particle oxide pigment ($a_2$) included in the nap (ultrafine fiber) are set to fall within specified ranges, and the yarn strength of the nap (ultrafine fiber) can thereby be increased, so that despite a high nap coverage of 70% or more, a sheet material resistant to falling off of fibers by rubbing can be obtained.

As for the nap coverage, a nap surface is enlarged to an observation magnification of 30 to 90 times to distinguish the presence of a nap by SEM, and the ratio of the gross area of nap portions per total area of 9 $mm^2$ is calculated using an image analysis software and employed as the nap coverage. The ratio of the gross area can be calculated using an image analysis software "ImageJ" by setting the nap portion and non-nap portion as a threshold value 100 and performing a binarization treatment on the photographed SEM image. Furthermore, in the calculation of the nap coverage, when a substance that is not a nap is calculated as a nap and greatly affects the nap coverage, the image is manually edited and that portion is calculated as a non-nap portion.

Examples of the image analysis system include the above-described image analysis software "ImageJ", but as long as the system includes an image processing software having a function of calculating an area ratio of specified pixels, the image analysis system is not limited to the image analysis software "ImageJ". Here, the image processing software "ImageJ" is a universal software and was developed at the U.S. National Institutes of Health. The image processing software "ImageJ" has a function of specifying the necessary region in a captured image and performing a pixel analysis.

In the sheet material of the present invention, the thickness measured in accordance with "6.1.1 Method A" of "6.1 Thickness (ISO method)" of JIS L1913:2010 "Test Methods for Nonwovens" is preferably in a range of 0.2 mm or more and 1.2 mm or less. When the thickness of the sheet material is 0.2 mm or more, more preferably 0.3 mm or more, still more preferably 0.4 mm or more, not only the processability at the time of production is excellent but also a sheet material exhibiting a sense of fulfillment and having an excellent texture is obtained. On the other hand, when the thickness is 1.2 mm or less, more preferably 1.1 mm or less, still more preferably 1.0 mm or less, a flexible sheet material having excellent formability can be obtained.

In the sheet material of the present invention, each of the color fastness to rubbing as measured in accordance with "9.1 Rubbing tester type I (crock meter) method" of JIS L0849:2013 "Test methods for colour fastness to rubbing" and the color fastness to light as measured in accordance with "7.2 Exposure method a) First exposure method" of JIS L0843:2006 "Test methods for colour fastness to xenon arc lamp light" is preferably evaluated as grade 4 or higher. When the color fastness to rubbing and the color fastness to light are in grade 4 or higher, color fading and staining of clothing or the like can be prevented during actual usage. For judgment of each grade, grey scale for assessing staining specified in JIS L0805:2005 "Grey scale for assessing staining" is used for color fastness to rubbing of the sheet material, and grey scale for assessing change in color specified in JIS L0804:2004 "Grey scale for assessing change in color" is used for color fastness to light of the sheet material.

In the sheet material of the present invention, the weight loss of the sheet material after 20,000 times of abrasion under a pressing load of 12.0 kPa in an abrasion test measured in accordance with "8.19.5 Method E (Martindale method)" of "8.19 Abrasion strength and color change by rubbing" of JIS L1096:2010 "Testing methods for woven and knitted fabrics" is preferably 10 mg or less, more preferably 8 mg or less, still more preferably 6 mg or less. When the weight loss is 10 mg or less, staining due to fluff dropping can be prevented during actual usage.

It is preferable that the sheet material of the present invention has dark-color and homogeneous chromogenic property and the lightness (L* value) of its surface is 25 or less. The lightness of the surface indicates an L* value specified in "3.3 CIE1976 lightness" of JIS Z8781-4:2013 "Colorimetry-Part 4: CIE 1976 L*a*b* Colour space" in the state that the surface having naps is used as the measurement surface and naps are laid down by means of a lint brush, etc. In the present invention, the measurement of L* value is conducted 10 times using a spectrophotometric colorimeter, and an arithmetic average of the measurement results is employed as the L* value of the sheet material.

Furthermore, in the sheet material of the present invention, the tensile strength as measured in accordance with "6.3.1 Tensile strength and percentage elongation (ISO method)" of JIS L1913:2010 "Test methods for nonwovens" is preferably from 20 to 200 N/cm in arbitrary measurement direction.

When the tensile strength is 20 N/cm or more, more preferably 30 N/cm or more, still more preferably 40 N/cm or more, the form stability and durability of the sheet material are excellent and therefore it is preferable. In addition, when the tensile strength is 200 N/cm or less, more preferably 180 N/cm or less, still more preferably 150 N/cm or less, a sheet material having excellent formability can be obtained.

[Production Method of Sheet Material]

The artificial leather of the present invention is preferably produced by a method including the following steps (1) to (4).

Step (1): A step of forming, in a fiber cross-section, an island portion including a polyester-based resin including the black pigment ($a_1$) or chromatic fine-particle oxide pigment ($a_2$) to produce an ultrafine fiber-developing fiber having a sea-island composite structure in which an easily soluble polymer forms the sea portion.

Step (2): A step of producing a fibrous substrate including the ultrafine fiber-developing fiber as a main structural component.

Step (3): A step of developing ultrafine fibers having an average single fiber diameter of 1.0 μm or more and 10.0 μm or less from the fibrous substrate including the ultrafine fiber-developing fiber as a main structural component.

Step (4): A step of applying a polymeric elastomer to the fibrous substrate including, as a main structural component, the ultrafine fiber or the ultrafine fiber-developing fiber.

Each step is described in detail below.

<Step of Producing Ultrafine Fiber-Developing Fiber>

In this step, an island portion including a polyester-based resin including the black pigment ($a_1$) or chromatic fine-particle oxide pigment ($a_2$) is formed in a fiber cross-section to produce an ultrafine fiber-developing fiber having a sea-island composite structure in which an easily soluble polymer forms the sea portion.

As the ultrafine fiber-developing fiber, a sea-island composite fiber in which thermoplastic resins differing in the solvent solubility are used for a sea portion (easily soluble polymer) and an island portion (low solubility polymer) and the island portion is caused to form an ultrafine fiber by dissolving and removing the sea portion with a solvent, etc., is used. Use of a sea-island composite fiber is favorable in view of the texture or surface quality of the sheet material, because at the time of removing the sea portion, an appropriate gap can be provided between islands, i.e., between ultrafine fibers inside a fiber bundle.

As the method for spinning the ultrafine fiber-developing fiber having a sea-island composite structure, a method using a mutually arranged polymer body in which a spinneret for sea-island composite fibers is used and the fiber is spun by mutually arranging a sea portion and an island portion is preferred from the viewpoint that ultrafine fibers having a uniform single fiber fineness are obtained.

As the method for letting the black pigment ($a_1$) or chromatic fine-particle oxide pigment ($a_2$) be included in the island portion, either a method of spinning fibers by using a polyester-based resin chip in which the black pigment ($a_1$) or chromatic fine-particle oxide pigment ($a_2$) is previously kneaded in an amount of, for example, 0.1 mass % or more and 5.0 mass % or less relative to the mass of the polyester-based resin, or a method of spinning fibers by mixing polyester-based resin chips and a masterbatch in which the black pigment ($a_1$) or chromatic fine-particle oxide pigment ($a_2$) is kneaded with a polyester-based resin in an amount of, for example, 10 mass % or more and 40 mass % or less relative to the mass of the polyester-based resin, can be employed. Of these, a method of using a masterbatch and mixing it with polyester-based resin chips is preferred, because the amount of the pigment included in the ultrafine fiber can be appropriately adjusted.

In the case of using a masterbatch and mixing it with polyester-based resin chips, a masterbatch in which a number average of the primary particle diameter of the black pigment ($a_1$) or chromatic fine-particle oxide pigment ($a_2$) included in the used masterbatch is 0.01 μm or more and 0.05 μm or less and a coefficient of variation (CV) is 30% or less, is preferably used. By using a masterbatch in which the primary particle diameter is in the range above, the particle diameter (secondary particle diameter) and coefficient of variation (CV) in the ultrafine fiber can be controlled to fall in appropriate ranges.

As to the sea portion of the sea-island composite fiber, for example, polyethylene, polypropylene, polystyrene, a copolymerized polyester formed by the copolymerization of sodium sulfoisophthalate, polyethylene glycol, etc., and polylactic acid can be used, but in view of the yarn-making property, ease of dissolution, etc., polystyrene or a copolymerized polyester is favorably used.

In the production method of the sheet material of the present invention, in the case of using a sea-island composite fiber, a sea-island composite fiber in which the strength of the island portion is 2.5 cN/dtex or more is preferably used. When the strength of the island portion is 2.5 cN/dtex or more, more preferably 2.8 cN/dtex or more, still more preferably 3.0 cN/dtex or more, the abrasion resistance of the sheet material is enhanced and at the same time, reduction in the color fastness to rubbing due to falling off of the fiber can be suppressed.

In the present invention, the strength of the island portion of the sea-island composite fiber is calculated according to the following method.

(1) 10 fibers of a sea-island composite fiber having a length of 20 cm are bundled.

(2) The sea portion is dissolved and removed from the sample of (1), and an air drying is performed.

(3) A test is performed 10 times (N=10) in accordance with "8.5.1 Standard time test" of "8.5 Tensile strength and percentage elongation" of JIS L1013:2010 "Testing methods for man-made filament yarns" under the conditions of a grasp interval of 5 cm, a tensile speed of 5 cm/min, and a load of 2 N.

(4) A value obtained by rounding the arithmetic average value (cN/dtex) of the test results of (3) to one decimal place is employed as the strength of the island portion of the sea-island composite fiber.

<Step of Producing Fibrous Substrate>

In this step, the spun-out ultrafine fiber-developing fiber is opened and passed through a cross lapper, etc. to form a fiber web, and the fiber web is then entangled to obtain a nonwoven fabric. As the method for obtaining a nonwoven fabric by entangling a fiber web, a needle punching treatment, a water jet punching treatment, etc. can be used.

As for the form of the nonwoven fabric, either a short-fiber nonwoven fabric or a long-fiber nonwoven fabric may be used as described above, but in the case of a short-fiber nonwoven fabric, the number of fibers oriented in the thickness direction of the sheet material is larger than in a long-fiber nonwoven fabric, and the surface of the sheet material at the time of being napped can give a highly dense feeling.

In the case where a short-fiber nonwoven fabric is used for the nonwoven fabric, the obtained ultrafine fiber-developing fibers are preferably crimped, cut to a predetermined length to obtain a raw cotton, then opened, laminated and entangled, thereby obtaining a short-fiber nonwoven fabric. For the crimping and cutting, known methods can be used.

Furthermore, in the case where the sheet material includes a woven fabric, the obtained nonwoven fabric and a woven fabric are layered, then entangled and integrated. For entangling and integrating the nonwoven fabric and a woven fabric, the fibers of the nonwoven fabric and woven fabric may be entangled with each other by a needle punching treatment, a water jet punching treatment, etc., after a woven fabric is layered on one surface or both surfaces of the nonwoven fabric, or after a woven fabric is inserted between a plurality of nonwoven fabric webs.

The apparent density of the nonwoven fabric including ultrafine fiber-developing fibers after the needle punching treatment or water jet punching treatment is preferably 0.15 g/cm$^3$ or more and 0.45 g/cm$^3$ or less. When the apparent density is preferably 0.15 g/cm$^3$ or more, the sheet material can have sufficient form stability and dimensional stability. On the other hand, when the apparent density is preferably 0.45 g/cm$^3$ or less, a sufficient space for applying a polymeric elastomer can be maintained.

Applying a heat shrinking treatment by warm water or steam to the nonwoven fabric so as to enhance the dense feeling of fibers is also a preferred embodiment.

Then, the nonwoven fabric can also be impregnated with an aqueous solution of a water-soluble resin and dried, thereby applying a water-soluble resin. By applying a water-soluble resin to the nonwoven fabric, the fibers are fixed and the dimensional stability is enhanced.

<Step of Developing Ultrafine Fibers>

In this step, the obtained fibrous substrate is treated with a solvent to develop ultrafine fibers in which the average single fiber diameter of single fibers is 1.0 μm or more and 10.0 μm or less.

The treatment for developing ultrafine fibers can be performed by immersing a nonwoven fabric including sea-island composite fibers in a solvent and dissolving and removing the sea portions of the sea-island composite fibers.

In the case where the ultrafine fiber-developing fiber is a sea-island composite fiber, as the solvent for dissolving and removing the sea portion, an organic solvent such as toluene or trichloroethylene can be used when the sea part is polyethylene, polypropylene or polystyrene. In addition, when the sea portion is a copolymerized polyester or polylactic acid, an aqueous alkali solution such as sodium hydroxide can be used. When the sea portion is a water-soluble thermoplastic polyvinyl alcohol-based resin, hot water can be used.

<Step of Applying Polymeric Elastomer>

In this step, the polymeric elastomer is applied by impregnating the fibrous substrate including, as a main structural component, the ultrafine fiber or the ultrafine fiber-developing fiber with a solution of a polymeric elastomer including the black pigment (b), and solidifying the solution. The method for fixing the polymeric elastomer including the black pigment (b) to the nonwoven fabric includes a method where the nonwoven fabric (fiber-entangled body) is impregnated with a solution of the polymeric elastomer including the black pigment (b) and then subjected to wet coagulation or dry coagulation, and such a method can be appropriately selected according to the type of the polymeric elastomer used. For the black pigment (b) used, the primary particle diameter preferably has a number average of 0.01 μm or more and 0.05 μm or less and preferably has a coefficient of variation (CV) of 30% or less. By using the black pigment (b) having a primary particle diameter in the range above, the particle diameter (secondary particle diameter) and coefficient of variation (CV) in the polymeric elastomer can be controlled to fall in appropriate ranges.

As the solvent used when applying polyurethane to the fibrous substrate as the polymeric elastomer, N,N'-dimethylformamide, dimethylsulfoxide, etc. are preferably used. In addition, a water-dispersible polyurethane solution prepared by dispersing polyurethane as an emulsion in water may also be used.

Incidentally, the polymeric elastomer may be applied to the fibrous substrate before generating ultrafine fibers from the ultrafine fiber-developing fibers, or after generating ultrafine fibers from the ultrafine fiber-developing fibers.

<Step of Half-Cutting and Grinding Sheet Material>

In view of production efficiency, an embodiment where after the completion of the step above, the sheet material provided with a polymeric elastomer is cut in half in the thickness direction into two fibrous substrates is also preferred.

Furthermore, a napping treatment is applied to a surface of the sheet material provided with a polymeric elastomer or the half-cut sheet material. The napping treatment can be performed, for example, by a method of grinding the sheet material using sandpaper, roll-sander, etc. The napping treatment may be applied only to one surface of the sheet material or may be applied to both surfaces.

In the case of performing a napping treatment, a lubricant such as silicone emulsion can be applied to the surface of the sheet material before the napping treatment. In addition, when an antistatic agent is applied before the napping treatment, the ground powder generated from the sheet material due to grinding is less likely to deposit on sandpaper. The sheet material is thus formed.

<Step of Dyeing Sheet Material>

The sheet material above is preferably subjected to a dyeing treatment with a dye having the same color as the black pigment or chromatic fine-particle oxide pigment. As the dyeing treatment, for example, a dip dyeing treatment such as a jet dyeing treatment using a jigger dyeing machine or a jet dyeing machine and a thermosol dyeing treatment using a continuous dyeing machine, or a printing treatment on a nap surface by roller printing, screen printing, inkjet printing, sublimation printing, vacuum sublimation printing, etc. can be used. Among them, in view of quality and fineness, a jet dyeing machine is preferably used, because a soft texture is obtained. In addition, as necessary, various kinds of resin finish processing may be applied after the dyeing.

<Post-Processing Step>

In the sheet material, a design may be applied to its surface, as necessary. For example, a post-processing treatment such as hole-forming processing such as perforation, emboss processing, laser processing, pinsonic processing and printing processing may be applied.

The sheet material of the present invention obtained by the production method exemplified above has a natural leather-like soft feel to the touch, dark-color and homogeneous chromogenic property and furthermore, excellent durability and can be used widely for applications ranging from furniture, chairs and vehicle interior material to clothing but is suitably used in particular for vehicle interior material because of its excellent color fastness to light.

EXAMPLES

The sheet material of the present invention is described more specifically below by referring to Examples, but the present invention is not limited only to these Examples. The evaluation methods and measurement conditions used in Examples are described. However, in the measurements of respective physical properties, unless otherwise specified, the measurement was performed based on the method described above.

[Measurement Methods and Processing Methods for Evaluation]

(1) Average Single Fiber Diameter (μm) of Ultrafine Fibers:

In the measurement of the average single fiber diameter of ultrafine fibers, the average single fiber diameter was calculated by observing the ultrafine fibers by means of a scanning electron microscope, Model "VW-9000", manufactured by Keyence Corp.

(2) Average and Coefficient of Variation (CV) of Particle Diameter of Black Pigment ($a_1$) or Chromatic Fine-Particle Oxide Pigment ($a_2$) Included in Ultrafine Fiber:

An ultrathin section in the cross-sectional direction of a surface perpendicular to the longitudinal direction of the ultrafine fiber was prepared using an ultramicrotome, "Model MT6000", manufactured by Sorvall. The obtained section was observed using a transmission electron microscope (manufactured by Hitachi High-Technologies Corporation, "Model H7700"). Subsequently, the particle diameter of the pigment was measured using an image analysis software (produced by Mitani Corporation, "WinROOF").

(3) Average and Coefficient of Variation (CV) of Particle Diameter of Black Pigment (b) Included in Polymeric Elastomer:

An ultrathin section in the cross-sectional direction of a surface perpendicular to the longitudinal direction of the sheet material was prepared using an ultramicrotome, "Model MT6000", manufactured by Sorvall. The obtained section was observed using a transmission electron microscope (manufactured by Hitachi High-Technologies Corporation, "Model H7700"). Subsequently, the particle diameter of the pigment was measured using an image analysis software (produced by Mitani Corporation, "WinROOF").

(4) Nap Coverage (%) of Sheet Material:

In the measurement of the nap coverage, "Model VW-9000" manufactured by Keyence Corp. as a scanning electron microscope and "ImageJ" as an image analysis software were used.

(5) Nap Length (μm) of Sheet Material:

In the measurement of the nap length of the sheet material, "Model VW-9000" manufactured by Keyence Corp. was used as a scanning electron microscope.

(6) Lightness (L* Value) of Sheet Material:

An L* value specified in "3.3 CIE1976 lightness" of JIS Z8781-4:2013 "Colorimetry-Part 4: CIE 1976 L*a*b* Colour space" was measured using a spectrophotometric colorimeter. The measurement was performed 10 times using "CR-310" manufactured by KONICA MINOLTA, INC., and the average thereof was employed as the L* value of the sheet material.

(7) Color Fastness to Rubbing of Sheet Material:

The degree of staining of the sample after the rubbing test was determined using a grey scale for assessing staining specified in JIS L0805:2005 "Grey scale for assessing staining", and grade 4 or higher (color difference $\Delta E^*_{ab}$ by L*a*b* color system is 4.5±0.3 or less) was judged as passed.

(8) Color Fastness to Light of Sheet Material:

The degree of discoloration of the sample after irradiation with xenon arc lamp light was determined according to grades by using a grey scale for assessing discoloration specified in JIS L0804:2004 "Grey scale for assessing change in color", and grade 4 or higher (color difference $\Delta E^*_{ab}$ by L*a*b* color system is 1.7±0.3 or less) was judged as passed.

(9) Abrasion Resistance of Sheet Material:

An abrasion resistance test was performed using "Model 406" manufactured by James H. Heal & Co. Ltd. as the abrasion tester and using "Abrastive CLOTH SM25" of the same company as the standard rubbing cloth, and sheet materials in which the abrasion loss of the sheet material was 10 mg or less were judged as passed.

(10) Tensile Strength of Sheet Material:

Two specimen sheets of 2 cm×20 cm were sampled in an arbitrary direction of the sheet material, and the tensile strength specified in "6.3.1 Tensile strength and percentage elongation (ISO method)" of JIS L1913:2010 "Test methods for nonwovens" was measured. In the measurement, the average of two sheets was employed as the tensile strength of the sheet material.

(11) Chromogenic Property of Sheet Material:

The chromogenic property of the sheet material was evaluated by a total of 20 evaluators consisting of 10 healthy adult men and 10 healthy adult women and after visually deciding the following ratings, the most common rating was employed as the chromogenic property of the sheet material. In the case of a tie between ratings, a higher rating was employed as the chromogenic property of the sheet material. The good level of the present invention is "A or B".

A: Very homogeneous chromogenic property

B: Homogeneous chromogenic property

C: Large variation in chromogenic property

D: Very large variation in chromogenic property

Example 1

<Step of Producing Raw Cotton>

An ultrafine fiber-developing fiber having a sea-island composite structure consisting of an island component and a sea component was melt-spun under the following conditions.

- Island component: A mixture of the following components P1 and P2 at a mass ratio of 95:5
  - P1: Polyethylene terephthalate A having an intrinsic viscosity (IV value) of 0.73
  - P2: A masterbatch containing, in the polyethylene terephthalate A, carbon black (average particle diameter: 0.02 μm, coefficient of variation (CV) of particle diameter: 20%) as the black pigment ($a_1$) in a ratio of 20 mass % relative to the mass of the masterbatch
- Sea component: Polystyrene having MFR (Melt Flow Rate, measured by the test method specified in ISO 1133:1997) of 65 g/10 min
- Spinneret: A spinneret for sea-island composite fibers, having a number of islands of 16 islands/hole
- Spinning temperature: 285° C.
- Island portion/sea portion mass ratio: 80/20
- Discharge rate: 1.2 g/(min-hole)
- Spinning speed: 1,100 m/min Subsequently, the ultrafine fiber-developing fiber was stretched 2.7 times in a spinning oil solution bath set at 90° C. After performing a crimping treatment using a push-in type crimper, the fiber was cut to a length of 51 mm to obtain a raw cotton of a sea-island composite fiber having a single fiber fineness of 4.2 dtex. The average single fiber diameter of the ultrafine fibers obtained from the sea-island composite fiber above was 4.4 μm, the strength of the ultrafine fiber was 3.7 cN/dtex, the average particle diameter of carbon black in the ultrafine fiber was 0.07 μm, and the coefficient of variation (CV) of the particle diameter was 30%.

<Step of Producing Fibrous Substrate>

First, using the raw cotton obtained above, a multilayer web was formed through carding and cross-lapping steps, and the needle punching treatment was performed with a number of punches of 2,500 punches/cm$^2$ to obtain a nonwoven fabric (fibrous substrate) having a mass per unit area of 540 g/m$^2$ and a thickness of 2.4 mm.

<Step of Developing Ultrafine Fiber>

The nonwoven fabric obtained above was shrunk in hot water at 96° C. The nonwoven fabric shrunk in hot water was then impregnated with an aqueous polyvinyl alcohol (PVA) solution with a saponification degree of 88% prepared to have a concentration of 12 mass %. Furthermore, the nonwoven fabric was squeezed with rollers and dried by hot air having a temperature of 120° C. for 10 minutes while allowing for migration of PVA, to obtain a PVA-impregnated sheet in which the mass of PVA was 25 mass % relative to the mass of the sheet base. The thus-obtained PVA-impregnated sheet was subjected to a process in which the PVA-impregnated sheet was immersed in trichloroethylene, and then squeezed and compressed with a mangle. The process was repeated ten times, thereby dissolving and removing the sea portion and compressing the PVA-impregnated sheet. Consequently, a PVA-impregnated sheet formed by entanglement of ultrafine fiber bundles to which PVA was applied was obtained.

<Step of Applying Polymeric Elastomer>

A DMF (dimethylformamide) solution of polyurethane prepared such that the main component thereof was a polyurethane containing carbon black (average primary particle diameter: 0.02 μm, coefficient of variation (CV) of particle diameter: 20%) as the black pigment (b) and the concentration of solid matters was 13% was soaked into the PVA-impregnated sheet obtained above. Thereafter, the sea-deprived PVA-impregnated sheet immersed in DMF solution of polyurethane was squeezed with rollers. Subsequently, the sheet was immersed in an aqueous DMF solution having a concentration of 30 mass % to coagulate the polyurethane. After that, PVA and DMF were removed by hot water, and the fibrous substrate was impregnated with a silicone oil emulsion solution adjusted to a concentration of 1 mass %, thereby applying a silicone-based lubricant such that the applied amount thereof was 0.5 mass % relative to the total mass of the mass of the fibrous substrate and the mass of the polyurethane, and then dried with hot air having a temperature of 110° C. for 10 minutes. Consequently, a polyurethane-impregnated sheet having a thickness of 1.8 mm, in which the mass of the polyurethane relative to the mass of the fibrous substrate was 33 mass % and the content of carbon black included in the polyurethane was 0.1 mass % relative to the total mass of polyurethane and carbon black, was obtained. The average particle diameter (secondary particle diameter) of carbon black in the polyurethane was 0.07 μm, and the coefficient of variation (CV) of the particle diameter was 30%.

<Step of Half-Cutting and Napping>

The polyurethane-impregnated sheet obtained above was cut in half such that the thickness of each part was ½. Subsequently, a napping treatment was performed by grinding the surface layer portion of the half-cut surface by 0.3 mm with an endless sandpaper having a sandpaper grit size of 180 to obtain a nap sheet having a thickness of 0.6 mm.

<Step of Dyeing and Finishing>

The nap sheet obtained above was dyed using a jet dyeing machine. At this time, a black dye was used at 120° C., and a recipe adjusted such that the L* value of the sheet material after dyeing becomes 22 was used. Thereafter, a drying treatment was performed at 100° C. for 7 minutes to obtain a sheet material having the average single fiber diameter of ultrafine fibers of 4.4 μm, the mass per unit area of 220 g/m$^2$, the thickness of 0.7 mm, the nap coverage of 85%, and the nap length of 330 μm. The obtained sheet material had excellent color fastness and abrasion resistance and high strength as well as dark-color and very homogeneous chromogenic property. The results are shown in Tables 1 and 2.

Example 2

A sheet material having the average particle diameter (secondary particle diameter) of carbon black in the polyurethane of 0.10 μm and the coefficient of variation (CV) of the particle diameter of 50% was obtained in the same manner as in Example 1 except that the ratio of carbon black included as the black pigment (b) in the polyurethane was 1.5 mass % relative to the total mass of polyurethane and carbon black. The obtained sheet material had excellent color fastness and abrasion resistance and high strength as well as dark-color and very homogeneous chromogenic property. The results are shown in Tables 1 and 2.

Example 3

A sheet material was obtained in the same manner as in Example 1 except that an ultrafine fiber-developing fiber having a sea-island composite structure consisting of an island component and a sea component was melt-spun under the following conditions and subsequently the ultrafine fiber-developing fiber was stretched 3.4 times in a spinning oil solution bath set at 90° C. The average single fiber diameter of ultrafine fibers constituting the sheet material was 2.9 μm, the strength of the ultrafine fiber was 3.5 cN/dtex, the average particle diameter of carbon black (black pigment ($a_1$)) in the ultrafine fiber was 0.075 μm, and the coefficient of variation (CV) of the particle diameter was 40%. The sheet material obtained by using the ultrafine fiber-developing fiber had excellent color fastness and abrasion resistance and high strength as well as dark-color and very homogeneous chromogenic property. The results are shown in Tables 1 and 2.

- Island component: A mixture of the following components P1 and P2 at a mass ratio of 95:5
  - P1: Polyethylene terephthalate A having an intrinsic viscosity (IV value) of 0.73
  - P2: A masterbatch containing, in the polyethylene terephthalate A, carbon black (average particle diameter: 0.025 μm, coefficient of variation (CV) of particle diameter: 20%) as the black pigment ($a_1$) in a ratio of 20 mass % relative to the mass of the masterbatch
- Sea component: Polystyrene having MFR (Melt Flow Rate, measured by the test method specified in ISO 1133:1997) of 65 g/10 min
- Spinneret: A spinneret for sea-island composite fibers, having a number of islands of 16 islands/hole
- Spinning temperature: 285° C.
- Island portion/sea portion mass ratio: 55/45
- Discharge rate: 1.0 g/(min-hole)
- Spinning speed: 1,100 m/min Example 4

A sheet material was obtained in the same manner as in Example 1 except that an ultrafine fiber-developing fiber having a sea-island composite structure consisting of an island component and a sea component was melt-spun under the following conditions and subsequently the ultrafine fiber-developing fiber was stretched 3.0 times in a spinning oil solution bath set at 90° C. The average single fiber diameter of ultrafine fibers constituting the sheet material was 5.5 μm, the strength of the ultrafine fiber was 3.3 cN/dtex, the average particle diameter of carbon black (black pigment ($a_1$)) in the ultrafine fiber was 0.08 μm, and the coefficient of variation (CV) of the particle diameter was 50%. The sheet material obtained by using the ultrafine fiber-developing fiber had excellent color fastness and abrasion resistance and high strength as well as dark-color and very homogeneous chromogenic property. The results are shown in Tables 1 and 2.

- Island component: A mixture of the following components P1 and P2 at a mass ratio of 95:5
  - P1: Polyethylene terephthalate A having an intrinsic viscosity (IV value) of 0.73
  - P2: A masterbatch containing, in the polyethylene terephthalate A, carbon black (average particle diameter: 0.03 μm, coefficient of variation (CV) of particle diameter: 20%) as the black pigment ($a_1$) in a ratio of 20 mass % relative to the mass of the masterbatch
- Sea component: Polystyrene having MFR (Melt Flow Rate, measured by the test method specified in ISO 1133:1997) of 65 g/10 min
- Spinneret: A spinneret for sea-island composite fibers, having a number of islands of 16 islands/hole
- Spinning temperature: 285° C.
- Island portion/sea portion mass ratio: 90/10
- Discharge rate: 1.8 g/(min-hole)
- Spinning speed: 1,100 m/min Example 5

A sheet material was obtained in the same manner as in Example 1 except that island components P1 and P2 were mixed to allow the ratio of carbon black included as the black pigment ($a_1$) in the ultrafine fiber to be 0.5 mass % relative to the mass of the ultrafine fiber. The average single fiber diameter of ultrafine fibers constituting the sheet material was 4.4 μm, the strength of the ultrafine fiber was 3.75 cN/dtex, the average particle diameter of carbon black in the ultrafine fiber was 0.06 μm, and the coefficient of variation (CV) of the particle diameter was 30%. The obtained sheet material exhibited slightly poor color fastness to light but had excellent color fastness to rubbing and abrasion resistance and high strength as well as dark-color and very homogeneous chromogenic property. The results are shown in Tables 1 and 2.

Example 6

A sheet material having the average particle diameter of carbon black in the polyurethane of 0.18 μm and the coefficient of variation (CV) of the particle diameter of 60% was obtained in the same manner as in Example 1 except that island components P1 and P2 were mixed to allow the ratio of carbon black included as the black pigment ($a_1$) in the ultrafine fiber to be 1.5 mass % relative to the mass of the ultrafine fiber and the ratio of carbon black included as the black pigment (b) in the polyurethane was 2.8 mass % relative to the total mass of polyurethane and carbon black. The average single fiber diameter of ultrafine fibers constituting the sheet material was 4.4 μm, the strength of the ultrafine fiber was 3.3 cN/dtex, the average particle diameter of carbon black in the ultrafine fiber was 0.09 μm, and the coefficient of variation (CV) of the particle diameter was 50%. The obtained sheet material exhibited slightly poor color fastness to rubbing but had excellent color fastness to light and abrasion resistance and relatively high strength as well as dark-color and very homogeneous chromogenic property. The results are shown in Tables 1 and 2.

Example 7

A sheet material having the average particle diameter of carbon black in the polyurethane of 0.10 μm and the coefficient of variation (CV) of the particle diameter of 50% was obtained in the same manner as in Example 1 except that island components P1 and P2 were mixed to allow the ratio of carbon black included as the black pigment ($a_1$) in the ultrafine fiber to be 3.0 mass % relative to the mass of the ultrafine fiber and the ratio of carbon black included as the black pigment (b) in the polyurethane was 1.5 mass % relative to the total mass of polyurethane and carbon black. The average single fiber diameter of ultrafine fibers constituting the sheet material was 4.4 μm, the strength of the ultrafine fiber was 2.7 cN/dtex, the average particle diameter of carbon black in the ultrafine fiber was 0.13 μm, and the coefficient of variation (CV) of the particle diameter was 60%. The obtained sheet material was slightly poor in color fastness to rubbing and abrasion resistance but had excellent color fastness to light and relatively high strength as well as dark-color and very homogeneous chromogenic property. The results are shown in Tables 1 and 2.

Example 8

A sheet material was obtained in the same manner as in Example 1 except that the silicone-based lubricant was applied such that the silicone-based lubricant applied amount was 0.2 mass % relative to the total mass of the mass of the fibrous substrate and the mass of the polyurethane and the napping treatment was performed by grinding the surface layer portion of the half-cut surface by 0.3 mm with an endless sandpaper having a sandpaper grit size of 240. The obtained sheet material had excellent color fastness and abrasion resistance and high strength as well as dark-color and homogeneous chromogenic property. The results are shown in Tables 1 and 2.

Example 9

A sheet material was obtained in the same manner as in Example 1 except that the napping treatment was performed by grinding the surface layer portion of the half-cut surface by 0.4 mm with an endless sandpaper having a sandpaper grit size of 150. The obtained sheet material had excellent color fastness and abrasion resistance and high strength as well as dark-color and homogeneous chromogenic property. The results are shown in Tables 1 and 2.

Example 10

A sheet material having the average particle diameter of carbon black in the polyurethane of 0.04 μm and the coefficient of variation (CV) of the particle diameter of 20% was obtained in the same manner as in Example 1 except that the ratio of carbon black included as the black pigment (b) in the polyurethane was 0.05 mass % relative to the total mass of polyurethane and carbon black. The obtained sheet material exhibited slightly poor color fastness to rubbing but had excellent color fastness to light and abrasion resistance and high strength as well as dark-color and very homogeneous chromogenic property. The results are shown in Tables 1 and 2.

Example 11

A sheet material having the average particle diameter of carbon black in the polyurethane of 0.21 μm and the coefficient of variation (CV) of the particle diameter of 80% was obtained in the same manner as in Example 1 except that island components P1 and P2 were mixed to allow the ratio of carbon black included as the black pigment ($a_1$) in the ultrafine fiber to be 1.9 mass % relative to the mass of the ultrafine fiber and the ratio of carbon black included as the black pigment (b) in the polyurethane was 3.1 mass % relative to the total mass of polyurethane and carbon black. The average single fiber diameter of ultrafine fibers constituting the sheet material was 4.4 μm, the strength of the ultrafine fiber was 2.9 cN/dtex, the average particle diameter of carbon black in the ultrafine fiber was 0.12 μm, and the coefficient of variation (CV) of the particle diameter was 55%. The obtained sheet material was slightly poor in color fastness to rubbing and abrasion resistance but had excellent color fastness to light and relatively high strength as well as dark-color and very homogeneous chromogenic property. The results are shown in Tables 1 and 2.

Example 12

A sheet material having the average single fiber diameter of ultrafine fibers of 4.4 μm, the mass per unit area of 320 g/m$^2$, the thickness of 0.9 mm, the nap coverage of 85%, and the nap length of 330 μm was obtained in the same manner as in Example 1 except that a multilayer web was formed through carding and cross-lapping steps by using the raw cotton described in Example 1, a plain fabric (mass per unit area: 75 g/m$^2$) having a weaving density of 95 warps/2.54 cm and 76 wefts/2.54 cm and using, for both the weft yarn and the warp yarn, a twisted yarn prepared by applying a twist of 2,500 T/m to multifilaments (average single fiber diameter: 11 μm, total fineness: 84 dtex, 72 filaments) including a polyethylene terephthalate having an intrinsic viscosity (IV value) of 0.65 was laminated to the top and bottom of the multilayer web, and then the needle punching treatment was performed with a number of punches of 2,500 punches/cm$^2$ to obtain a nonwoven fabric having a mass per unit area of 700 g/m$^2$ and a thickness of 3.0 mm. The obtained sheet material had excellent color fastness and abrasion resistance and very high strength as well as dark-color and homogeneous chromogenic property. The results are shown in Tables 3 and 4.

Example 13

A sheet material having the average single fiber diameter of ultrafine fibers of 4.4 μm, the mass per unit area of 320 g/m$^2$, the thickness of 0.9 mm, the nap coverage of 85%, and the nap length of 330 μm was obtained in the same manner as in Example 1 except that a multilayer web was formed through carding and cross-lapping steps by using the raw cotton described in Example 1, a plain fabric (mass per unit area: 75 g/m$^2$) having a weaving density of 95 warps/2.54 cm and 76 wefts/2.54 cm and using, for both the weft yarn and the warp yarn, a twisted yarn prepared by applying a twist of 2,500 T/m to multifilaments (average single fiber diameter: 11 μm, 84 dtex, 72 filaments) including a polyethylene terephthalate including 1.0 mass % of carbon black and having an intrinsic viscosity (IV value) of 0.55 was laminated to the top and bottom of the multilayer web, and then the needle punching treatment was performed with a number of punches of 2,500 punches/cm$^2$ to obtain a nonwoven fabric having a mass per unit area of 700 g/m$^2$ and a thickness of 3.0 mm. The obtained sheet material had excellent color fastness and abrasion resistance and very high strength as well as dark-color and homogeneous chromogenic property. The results are shown in Tables 3 and 4.

Example 14

A sheet material was obtained in the same manner as in Example 1 except that the mixed component P2 was a masterbatch containing, in the polyethylene terephthalate A, a blue fine-particle oxide pigment ("TM Blue 3490E" produced by Dainichiseika Color & Chemicals Mfg. Co., Ltd., average particle diameter: 0.02 μm, coefficient of variation (CV) of particle diameter: 20%) as the chromatic fine-particle oxide pigment ($a_2$) in a ratio of 20 mass % relative to the mass of the masterbatch and the dyeing was performed by using a blue dye. The average single fiber diameter of ultrafine fibers constituting the sheet material was 4.4 μm, the strength of the ultrafine fiber was 3.65 cN/dtex, the average particle diameter of the fine-particle oxide pigment in the ultrafine fiber was 0.075 μm, and the coefficient of variation (CV) of the particle diameter was 35%. The obtained sheet material had excellent color fastness and abrasion resistance and high strength as well as dark-color and very homogeneous chromogenic property. The results are shown in Tables 3 and 4.

TABLE 3

| | Example | | |
|---|---|---|---|
| | 12 | 13 | 14 |
| Ultrafine fiber component | PET | PET | PET |
| Average single fiber diameter (μm) of ultrafine fibers | 4.4 | 4.4 | 4.4 |
| Strength (cN/dtex) of ultrafine fiber | 3.7 | 3.7 | 3.65 |
| Average particle diameter (μm) of black pigment ($a_1$) or chromatic fine-particle oxide pigment ($a_2$) in ultrafine fiber | 0.07 | 0.07 | 0.075 |
| Coefficient of variation (%) of particle diameter of black pigment ($a_1$) or chromatic fine-particle oxide pigment ($a_2$) in ultrafine fiber | 30 | 30 | 35 |
| Content (A) (%) of black pigment ($a_1$) or chromatic fine-particle oxide pigment ($a_2$) in ultrafine fiber | 1.0 | 1.0 | 1.0 |
| Presence or absence of woven fabric | present | present | none |
| Average single fiber diameter (μm) of woven fabric | 11.0 | 11.0 | — |

TABLE 1

| | Example | | | | | | | | | | |
|---|---|---|---|---|---|---|---|---|---|---|---|
| | 1 | 2 | 3 | 4 | 5 | 6 | 7 | 8 | 9 | 10 | 11 |
| Ultrafine fiber component | PET | PET | PET | PET | PET | PET | PET | PET | PET | PET | PET |
| Average single fiber diameter (μm) of ultrafine fibers | 4.4 | 4.4 | 2.9 | 5.5 | 4.4 | 4.4 | 4.4 | 4.4 | 4.4 | 4.4 | 4.4 |
| Strength (cN/dtex) of ultrafine fiber | 3.7 | 3.7 | 3.5 | 3.3 | 3.75 | 3.3 | 2.7 | 3.7 | 3.7 | 3.7 | 2.9 |
| Average particle diameter (μm) of black pigment ($a_1$) or chromatic fine-particle oxide pigment ($a_2$) in ultrafine fiber | 0.07 | 0.07 | 0.075 | 0.08 | 0.06 | 0.09 | 0.13 | 0.07 | 0.07 | 0.07 | 0.12 |
| Coefficient of variation (%) of particle diameter of black pigment ($a_1$) or chromatic fine-particle oxide pigment ($a_2$) in ultrafine fiber | 30 | 30 | 40 | 50 | 30 | 50 | 60 | 30 | 30 | 30 | 55 |
| Content (A) (%) of black pigment ($a_1$) or chromatic fine-particle oxide pigment ($a_2$) in ultrafine fiber | 1.0 | 1.0 | 1.0 | 1.0 | 0.5 | 1.5 | 3.0 | 1.0 | 1.0 | 1.0 | 1.9 |
| Presence or absence of woven fabric | none | none | none | none | none | none | none | none | none | none | none |
| Average single fiber diameter (μm) of woven fabric | — | — | — | — | — | — | — | — | — | — | — |
| Polymeric elastomer component | PU | PU | PU | PU | PU | PU | PU | PU | PU | PU | PU |
| Average particle diameter (μm) of black pigment (b) in polymeric elastomer | 0.07 | 0.10 | 0.07 | 0.07 | 0.07 | 0.18 | 0.10 | 0.07 | 0.07 | 0.04 | 0.21 |
| Coefficient of variation (%) of particle diameter of black pigment (b) in polymeric elastomer | 30 | 50 | 30 | 30 | 30 | 60 | 50 | 30 | 30 | 20 | 80 |
| Content (B) (%) of black pigment (b) in polymeric elastomer | 0.1 | 1.5 | 0.1 | 0.1 | 0.1 | 2.8 | 1.5 | 0.1 | 0.1 | 0.05 | 3.1 |
| (A)/(B) | 10.0 | 0.66 | 10.0 | 10.0 | 5.0 | 0.54 | 2.0 | 10.0 | 10.0 | 20.0 | 0.61 |
| Nap coverage (%) on sheet material surface | 85 | 85 | 90 | 80 | 85 | 85 | 85 | 70 | 75 | 85 | 85 |
| Nap length (μm) of sheet material | 330 | 330 | 450 | 280 | 330 | 330 | 330 | 180 | 530 | 330 | 330 |

TABLE 2

| | Example | | | | | | | | | | |
|---|---|---|---|---|---|---|---|---|---|---|---|
| | 1 | 2 | 3 | 4 | 5 | 6 | 7 | 8 | 9 | 10 | 11 |
| Color fastness to rubbing of sheet material (grade) | 4.5 | 4.5 | 4.5 | 4.5 | 4.5 | 4 | 4 | 4.5 | 4.5 | 4 | 4 |
| Color fastness to light of sheet material (grade) | 4.5 | 4.5 | 4.5 | 4.5 | 4 | 4.5 | 4.5 | 4.5 | 4.5 | 4.5 | 4.5 |
| L* Value of sheet material | 22 | 22 | 22 | 22 | 22 | 22 | 22 | 22 | 22 | 22 | 22 |
| Abrasion resistance (mg) of sheet material | 4.2 | 4.2 | 4.8 | 5.2 | 4.2 | 6.0 | 7.5 | 4.2 | 5.6 | 5.2 | 6.4 |
| Tensile strength (N/cm) of sheet material | 69 | 68 | 60 | 59 | 72 | 53 | 52 | 69 | 70 | 68 | 54 |
| Chromogenic property of sheet material | A | A | A | A | A | A | A | B | B | A | A |

TABLE 3-continued

| | Example | | |
|---|---|---|---|
| | 12 | 13 | 14 |
| Polymeric elastomer component | PU | PU | PU |
| Average particle diameter (μm) of black pigment (b) in polymeric elastomer | 0.07 | 0.07 | 0.07 |
| Coefficient of variation (%) of particle diameter of black pigment (b) in polymeric elastomer | 30 | 30 | 30 |
| Content (B) (%) of black pigment (b) in polymeric elastomer | 0.1 | 0.1 | 0.1 |
| (A)/(B) | 10.0 | 10.0 | 10.0 |
| Nap coverage (%) on sheet material surface | 85 | 85 | 85 |
| Nap length (μm) of sheet material | 330 | 330 | 330 |

TABLE 4

| | Example | | |
|---|---|---|---|
| | 12 | 13 | 14 |
| Color fastness to rubbing of sheet material (grade) | 4.5 | 4.5 | 4.5 |
| Color fastness to light of sheet material (grade) | 4.5 | 4.5 | 4.5 |
| L* Value of sheet material | 22 | 22 | 22 |
| Abrasion resistance (mg) of sheet material | 4.0 | 4.5 | 4.6 |
| Tensile strength (N/cm) of sheet material | 119 | 97 | 69 |
| Chromogenic property of sheet material | B | B | A |

Comparative Example 1

A sheet material was obtained in the same manner as in Example 1 except that the island component P2 was a masterbatch containing, in the polyethylene terephthalate A, carbon black (average particle diameter: 0.06 μm, coefficient of variation (CV) of particle diameter: 60%) as the black pigment ($a_1$) in an amount of 20 mass % relative to the mass of the masterbatch. The average single fiber diameter of ultrafine fibers constituting the sheet material was 4.4 μm, the strength of the ultrafine fiber was 2.3 cN/dtex, the average particle diameter of carbon black in the ultrafine fiber was 0.22 μm, and the coefficient of variation (CV) of the particle diameter was 80%. The obtained sheet material had excellent color fastness to light and dark-color and very homogeneous chromogenic property but was a sheet material poor in color fastness to rubbing, abrasion resistance and strength. The results are shown in Tables 5 and 6.

Comparative Example 2

A sheet material was obtained in the same manner as in Example 1 except that the fiber was melt-spun using only the island component P1 as the island component. The average single fiber diameter of ultrafine fibers constituting the sheet material was 4.4 μm, and the strength of the ultrafine fiber was 3.8 cN/dtex. The obtained sheet material had excellent color fastness to rubbing, abrasion resistance and strength as well as very homogeneous chromogenic property but was a sheet material poor in color fastness to light. The results are shown in Tables 5 and 6.

Comparative Example 3

A sheet material was obtained in the same manner as in Example 1 except that a DMF (dimethylformamide) solution of polyurethane prepared such that the main component was a polyurethane not including carbon black (average particle diameter: 0.02 μm, coefficient of variation (CV) of particle diameter: 20%) as the black pigment (b) and the concentration of solid matters was 13% was soaked. The obtained sheet material had excellent color fastness and abrasion resistance and high strength but was a sheet material having a large variation in chromogenic property. The results are shown in Tables 5 and 6.

Comparative Example 4

A sheet material was obtained in the same manner as in Example 1 except that a silicone-based lubricant was not applied to the polyurethane-impregnated sheet. The obtained sheet material had excellent color fastness and abrasion resistance and high strength but was a sheet material having a very large variation in chromogenic property. The results are shown in Tables 5 and 6.

TABLE 5

| | Comparative Example | | | |
|---|---|---|---|---|
| | 1 | 2 | 3 | 4 |
| Ultrafine fiber component | PET | PET | PET | PET |
| Average single fiber diameter (μm) of ultrafine fibers | 4.4 | 4.4 | 4.4 | 4.4 |
| Strength (cN/dtex) of ultrafine fiber | 2.3 | 3.8 | 3.7 | 3.7 |
| Average particle diameter (μm) of black pigment ($a_1$) or chromatic fine-particle oxide pigment ($a_2$) in ultrafine fiber | 0.22 | — | 0.07 | 0.07 |
| Coefficient of variation (%) of particle diameter of black pigment ($a_1$) or chromatic fine-particle oxide pigment ($a_2$) in ultrafine fiber | 80 | — | 30 | 30 |
| Content (A) (%) of black pigment ($a_1$) or chromatic fine-particle oxide pigment ($a_2$) in ultrafine fiber | 1.0 | — | 1.0 | 1.0 |
| Presence or absence of woven fabric | none | none | none | none |
| Average single fiber diameter (μm) of woven fabric | — | — | — | — |
| Polymeric elastomer component | PU | PU | PU | PU |

TABLE 5-continued

| | Comparative Example | | | |
|---|---|---|---|---|
| | 1 | 2 | 3 | 4 |
| Average particle diameter (μm) of black pigment (b) in polymeric elastomer | 0.07 | 0.07 | — | 0.07 |
| Coefficient of variation (%) of particle diameter of black pigment (b) in polymeric elastomer | 30 | 30 | — | 30 |
| Content (B) (%) of black pigment (b) in polymeric elastomer | 0.1 | 0.1 | — | 0.1 |
| (A)/(B) | 10.0 | — | — | 10.0 |
| Nap coverage (%) on sheet material surface | 85 | 85 | 85 | 50 |
| Nap length (μm) of sheet material | 330 | 330 | 330 | 250 |

TABLE 6

| | Comparative Example | | | |
|---|---|---|---|---|
| | 1 | 2 | 3 | 4 |
| Color fastness to rubbing of sheet material (grade) | 3 | 4.5 | 4.5 | 4.5 |
| Color fastness to light of sheet material (grade) | 4.5 | 2 | 4.5 | 4.5 |
| L* Value of sheet material | 22 | 22 | 22 | 22 |
| Abrasion resistance (mg) of sheet material | 12.2 | 3.8 | 4.2 | 4.2 |
| Tensile strength (N/cm) of sheet material | 39 | 72 | 69 | 71 |
| Chromogenic property of sheet material | A | A | C | D |

As shown in Tables 1 to 4, in the sheet materials of Examples 1 to 14, since exposure of the polymeric elastomer to the surface of the sheet material could be suppressed by setting the nap coverage of the sheet material to fall within the specified range, sheet materials having dark-color and homogeneous chromogenic property were obtained. Furthermore, even in the case where the nap coverage was high, since a decrease in the strength of the ultrafine fiber could be suppressed and the ultrafine fiber could be prevented from falling off due to rubbing by setting the average particle diameter of the carbon black (black pigment ($a_1$)) or chromatic fine-particle oxide pigment ($a_2$) included in ultrafine fibers constituting the sheet material to fall within the specified range and by reducing the coefficient of variation (CV) of the particle diameter, sheet materials having excellent color fastness to rubbing and abrasion resistance, in addition to dark-color and homogeneous chromogenic property, were obtained.

On the other hand, as shown in Tables 5 and 6, in the case where the average particle diameter of carbon black (black pigment ($a_1$)) included in ultrafine fibers constituting the sheet material was out of the specified range or the coefficient of variation (CV) of the particle diameter of carbon black (black pigment ($a_1$)) was out of the specified range, as in the sheet material of Comparative Example 1, the strength of the ultrafine fiber was significantly reduced and consequently, the sheet material was poor in color fatness to rubbing and abrasion resistance.

In addition, as in the sheet material of Comparative Example 2, in the case where the ultrafine fiber included neither the black pigment ($a_1$) nor the chromatic fine-particle oxide pigment ($a_2$), the dye was deteriorated by the irradiation with light to cause a significant change in the hue of the ultrafine fiber and consequently, the sheet material was poor in color fatness to light.

Furthermore, as in the sheet material of Comparative Example 3, in the case where the polyurethane did not include carbon black (black pigment (b)), the polyurethane was not dyed with a dye and became white and consequently, the sheet material had a variation in chromogenic property. As in the sheet material of Comparative Example 4, in the case where the nap coverage is low, since the polyurethane was exposed to the surface of the sheet material, homogeneous chromogenic property was not obtained, and the sheet material was poor in texture and quality.

While the present invention has been described in detail and with reference to specific embodiments thereof, it will be apparent to one skilled in the art that various changes and modifications can be made therein without departing from the intention and scope of the present invention.

The invention claimed is:

1. A sheet material comprising a polymeric elastomer and a fiber-entangled body comprising, as a constituent element, a nonwoven fabric comprising ultrafine fibers having an average single fiber diameter of 1.0 μm or more and 10.0 μm or less, wherein:

the ultrafine fibers comprise a polyester-based resin comprising a black pigment ($a_1$);

the black pigment ($a_1$) has an average particle diameter of 0.05 μm or more and 0.20 μm or less and has a coefficient of variation (CV) of particle diameter of 30% or more and 75% or less;

the polymeric elastomer comprises a polyurethane comprising a black pigment (b);

the black pigment (b) has an average particle diameter of 0.05 μm or more and 0.20 μm or less and has a coefficient of variation (CV) of particle diameter of 30% or more and 75% or less;

the sheet material has a nap coverage of 70% or more and 90% or less on a surface having a nap; and the sheet material has a nap length on the surface of 250 μm or more and 450 μm or less.

2. The sheet material according to claim 1, wherein the ultrafine fibers have a content (A) of the black pigment ($a_1$) of 0.5 mass % or more and 2.0 mass % or less, and the polymeric elastomer has a content (B) of the black pigment (b), satisfying the below formula relative to the content (A) of the black pigment ($a_1$):

$$(A)/(B) \geq 0.6.$$

3. The sheet material according to claim 1, wherein the black pigment (b) is a carbon black.

4. The sheet material according to claim 1, wherein the black pigment ($a_1$) and the black pigment (b) are each a carbon black.

5. The sheet material according to claim 1, wherein the fiber-entangled body consists of the nonwoven fabric.

6. The sheet material according to claim 1, wherein the fiber-entangled body further comprises a woven fabric, and the nonwoven fabric and the woven fabric are entangled and integrated with each other.

7. The sheet material according to claim 6, wherein the woven fabric comprises fibers having an average single fiber diameter of 1.0 μm or more and 50.0 μm or less.

8. The sheet material according to claim 6, wherein the fibers constituting the woven fabric are fibers free from the black pigment ($a_1$).

9. The sheet material according to claim 6, wherein the woven fabric comprises fibers having an average single fiber diameter of 11.0 μm or more and 50.0 μm or less.

* * * * *